US006121732A

United States Patent [19]

Parker et al.

[11] Patent Number: 6,121,732

[45] Date of Patent: Sep. 19, 2000

[54] NEON LAMP POWER SUPPLY FOR PRODUCING A BUBBLE-FREE DISCHARGE WITHOUT PROMOTING MERCURY MIGRATION OR PREMATURE CORE SATURATION

[75] Inventors: Francis J. Parker, Cooper City; Robert Crawbuck, Jupiter, both of Fla.

[73] Assignee: Inshore Holdings, LLC, Miami, Fla.

[21] Appl. No.: 08/851,882

[22] Filed: May 6, 1997

[51] Int. Cl.[7] ..... H05B 37/02

[52] U.S. Cl. ..... 315/209 R; 315/219; 315/224; 315/DIG. 5

[58] Field of Search ..... 315/219, 209 R, 315/307, 308, 246, 247, 291, 175, 176, DIG. 5, DIG. 2, DIG. 7, 224, 225, 194, 174, 276, 287, 358

[56] References Cited

U.S. PATENT DOCUMENTS

| | | | |
|---|---|---|---|
| 4,891,561 | 1/1990 | Amano et al. | 315/223 |
| 5,023,518 | 6/1991 | Mans et al. | 315/219 |
| 5,072,155 | 12/1991 | Sakurai et al. | 315/219 |
| 5,075,598 | 12/1991 | Doss | 315/224 |
| 5,087,860 | 2/1992 | Doss | 315/224 |
| 5,089,752 | 2/1992 | Pacholok | 315/307 |
| 5,103,138 | 4/1992 | Orenstein et al. | 315/209 R |
| 5,187,413 | 2/1993 | Araki et al. | 315/291 |
| 5,189,343 | 2/1993 | Pacholok | 315/219 |
| 5,231,333 | 7/1993 | Orenstein | 315/219 |
| 5,352,956 | 10/1994 | Doss | 315/224 |
| 5,365,151 | 11/1994 | Spiegel et al. | 315/209 R |
| 5,367,224 | 11/1994 | Pacholok | 315/219 |
| 5,367,225 | 11/1994 | Pacholok et al. | 315/219 |
| 5,416,387 | 5/1995 | Cuk et al. | 315/209 R |
| 5,497,310 | 3/1996 | Noda et al. | 363/17 |

*Primary Examiner*—David H. Vu
*Attorney, Agent, or Firm*—Jay H. Maioli

[57] ABSTRACT

A power supply for a gas-discharge lamp includes a voltage source and drive circuit that produces an asymmetric output, a step-up transformer for stepping up the voltage to an appropriate level for driving the lamp, a blocking capacitor connected in series with the transformer and the lamp for preventing DC current from flowing through the transformer and the lamp to avoid core saturation of the transformer. A DC voltage is established across the lamp that prevents the formation of "bubbles" or "beads" in the gas discharge. An inverter is used to periodically reverse the polarity of the DC voltage to prevent mercury migration in mercury-containing lamps.

16 Claims, 10 Drawing Sheets

NEON LAMP POWER SUPPLY FOR PRODUCING A BUBBLE-FREE DISCHARGE WITHOUT PROMOTING MERCURY MIGRATION OR PREMATURE CORE SATURATION

BACKGROUND

The present invention relates to power supplies for use with gas-discharge display lamps. More particularly, the present invention relates to power supplies for use with inert gas lamps such as neon lamps, for example, and lamps containing mercury and an inert gas.

Historically, in the early generations of neon signs, neon lamps or tubes forming the neon signs were powered with "core and coil" transformers operating at a low AC frequency such as the frequency of the public utility, for example. These transformers, however, were generally cumbersome to use because of their size and weight. It should be understood that the term "neon lamp" is used herein to refer to all gas-discharge lamps that use an inert gas and is not limited to lamps that contain only neon gas.

Later generations of neon lamps were powered with more compact power supplies operating at higher AC frequencies, typically in the kilohertz range and above.

One problem that occurs with the use of high frequency power supplies, however, is the generation of "bubbles" or "beads" in the gas discharge. The bubbles form a nodal pattern of alternating high and low intensity regions that resembles a string of beads. This nodal pattern is caused by standing waves that are present within the neon tube and which are produced by high frequency excitation of the gas. The pattern may move along the length of the neon tube depending on the excitation frequency of the power supply and the particular geometry or shape of the neon tube. In addition, the presence of bends and splices, for example, will affect the frequency at which bubbling occurs. Neon tubes are often formed into a complex assembly of letters or artistic shapes and designs, thus increasing the likelihood of bubbling. Therefore, it may not be technically feasible to select an operating frequency at which bubbling does not occur throughout the various neon tube lengths that are present in a complex neon tube assembly. In many cases, more than one nodal pattern will occur in a single neon tube, and each nodal pattern may move at different velocities and in different directions.

One way to eliminate bubbling is to add a DC component to the AC input power. FIG. 1 illustrates a conventional circuit for generating a DC component in a power supply for a neon tube. Voltage output from the high frequency AC voltage source 10 passes through the inductor 12, which limits the amount of current drawn by the neon tube 14. The input voltage is stepped up by an output transformer 16 to an appropriate level for driving the neon tube 14. An automatic bias circuit 18, consisting of a capacitor 20 and a diode 22 connected in parallel, allows current to flow in one direction from the anode 24 to the cathode 26 of the diode 22. Current flow in the opposite direction acts to back bias the diode 22, thus allowing the capacitor 20 to charge up and to produce the DC voltage component.

Mercury vapor is often used in neon tubes to alter the color of the light that is produced. Also, mercury vapor is commonly used in phosphor-coated neon tubes as a medium for exciting the phosphor to produce a luminous glow therefrom. Radiation produced in the mercury gas discharge is an effective excitation source for the phosphor coating.

Neon signs often have segments of different colors that are produced by using various phosphors and/or gases that discharge those different colors, and it is desirable to have a single power supply for the entire assembly.

When mercury-containing tubes are powered by a power supply having a DC component, such as that described above, mercury atoms tend to migrate toward the cathode or the negative end of the neon tube. This migration causes a deficiency of mercury near the positive end, which results in the undesirable effect of the negative end glowing brighter than the positive end. As discussed above, however, a DC component is necessary to prevent bubbling in neon tubes and therefore cannot be completely eliminated from power supplies used for mercury-containing lamps.

One method for reducing the effects of mercury migration is proposed in U.S. Pat. No. 5,189,343 and U.S. Pat. No. 5,367,225, both assigned to Everbrite, Inc. The Everbrite method consists of alternating the polarity of the DC current flowing through the neon tube by using high-voltage semiconductor switches connected to the secondary windings of the output transformer. An alternative method proposed by Everbrite is to apply an asymmetrical waveform to the neon tube, which acts in conjunction with the geometry of the neon tube to produce a DC offset current therethrough.

The generation of the DC current by use of an asymmetrical waveform may be understood by considering the voltage-current characteristics of a neon tube. When operated at a high frequency, the neon tube has voltage-current characteristics similar to a pair of Zener diodes $D_a$, $D_b$ connected back to back and in series with a resistor R, as schematically shown in the equivalent circuit of FIG. 2. Little current will flow below the breakdown voltage of the diodes $D_a$, $D_b$, and above the breakdown voltage the current through the equivalent circuit, and thus through the neon lamp, is limited by the impedance of the external circuit connected thereto, such as by the impedance of the inductor 12 of FIG. 1. The resistor R of the equivalent circuit of FIG. 2 is not effective in limiting current because its impedance is, in general, low compared with the impedance of the inductor 12. Also, the neon tube can have bi-stable operating points, in which a single operating voltage can give rise to two different operating currents, and therefore the internal resistance of the neon tube (or R in FIG. 2) is not a predictable means for limiting current.

According to FIG. 3, if the high-frequency AC voltage source 30 has an asymmetrical output waveform, such as that shown in FIG. 4, a corresponding asymmetrical current is produced and supplied to the inductor 32 and then to the output transformer 36 of FIG. 3. This asymmetrical current flows from the secondary windings 38 of the output transformer 36 to the neon tube 34.

In theory, if the neon tube 34 is replaced with a purely resistive load, the asymmetrical current through the resistive load would resemble the waveform through the secondary windings 38. Specifically, as shown in FIG. 4, the average current over a complete current cycle would be equal to zero but the peak current would have a magnitude that depends on its polarity. In other words, the peak current during one polarity of the current cycle would be larger than the peak current during the other polarity of the current cycle, with the overall average current being zero over the complete current cycle.

In practice, the resistive load discussed above cannot adequately represent the neon tube 34 because the symmetrical nature of the neon tube 34 does not allow it to follow the asymmetrical current as faithfully as the resistive load would. Although the average voltage across the secondary windings 38 and the neon tube 34 is zero over a complete voltage cycle, the average current through the secondary windings 38 and the neon tube 34 is not zero. Instead, a DC offset current is established that acts to compensate for the asymmetrical current supplied to the neon tube 34. This DC offset current produced by the asymmetrical voltage source 30 serves to prevent bubble formation in the neon tube 34 in a manner similar to that in which the DC component produced by the automatic bias circuit 18 of FIG. 1 serves to prevent bubble formation.

An undesirable effect of establishing a DC offset current through the secondary windings 38 of the output transformer 36 is that the DC offset current can result in a DC offset flux produced by the transformer 36, which can result in premature core saturation. An air gap set up in the flux path may be used to prevent DC offset current-induced core saturation, however, such an air gap would lead to excessive losses in the transformer 36 due to stray flux emanating from the air gap.

OBJECTS AND SUMMARY OF THE INVENTION

In view of the above-mentioned deficiencies in existing neon lamp power supplies, it is an object of the present invention to provide an improved neon lamp power supply that powers neon lamps or tubes to produce a bubble-free gas discharge without promoting mercury migration, and that does not suffer from premature core saturation caused by a DC offset current.

According to an aspect of the present invention, a neon lamp power supply includes a high-frequency voltage source for producing an asymmetrical voltage, a high-voltage transformer for stepping up the voltage to an appropriate level for driving a neon tube, and a blocking capacitor connected in series with the transformer and the neon tube for preventing DC current from flowing through the transformer and the neon tube, thus preventing core saturation. A DC offset voltage is established across the neon tube that prevents the formation of bubbles. A timer periodically reverses the polarity of the DC voltage to prevent mercury migration.

DETAILED DESCRIPTION OF PREFERRED EMBODIMENTS

Figure 1:
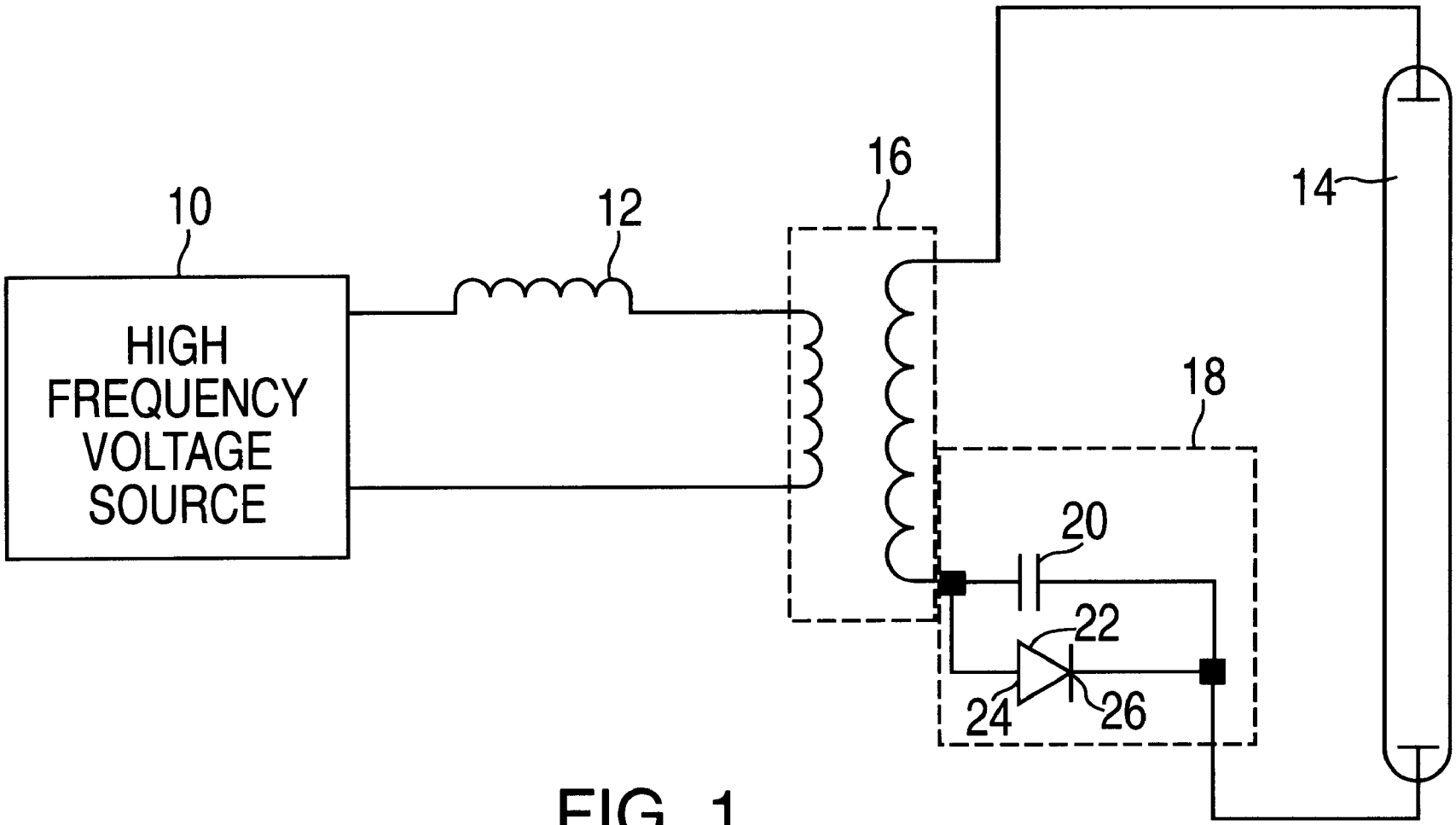
FIG. 1 PRIOR ART
FIG. 1 is a circuit diagram for a conventional neon lamp power supply that includes an automatic bias circuit.
Figure 2:
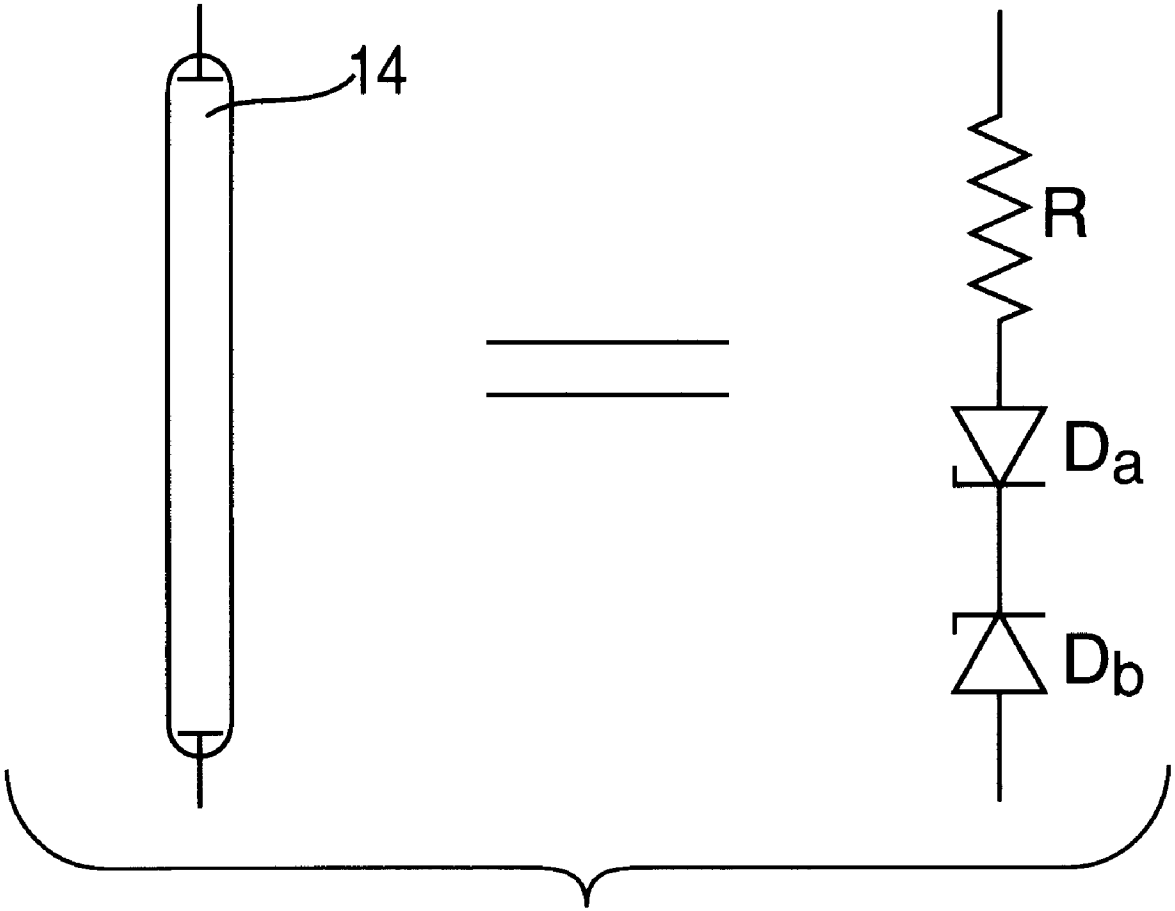
FIG. 2 is an equivalent circuit for a neon tube.
Figure 3:
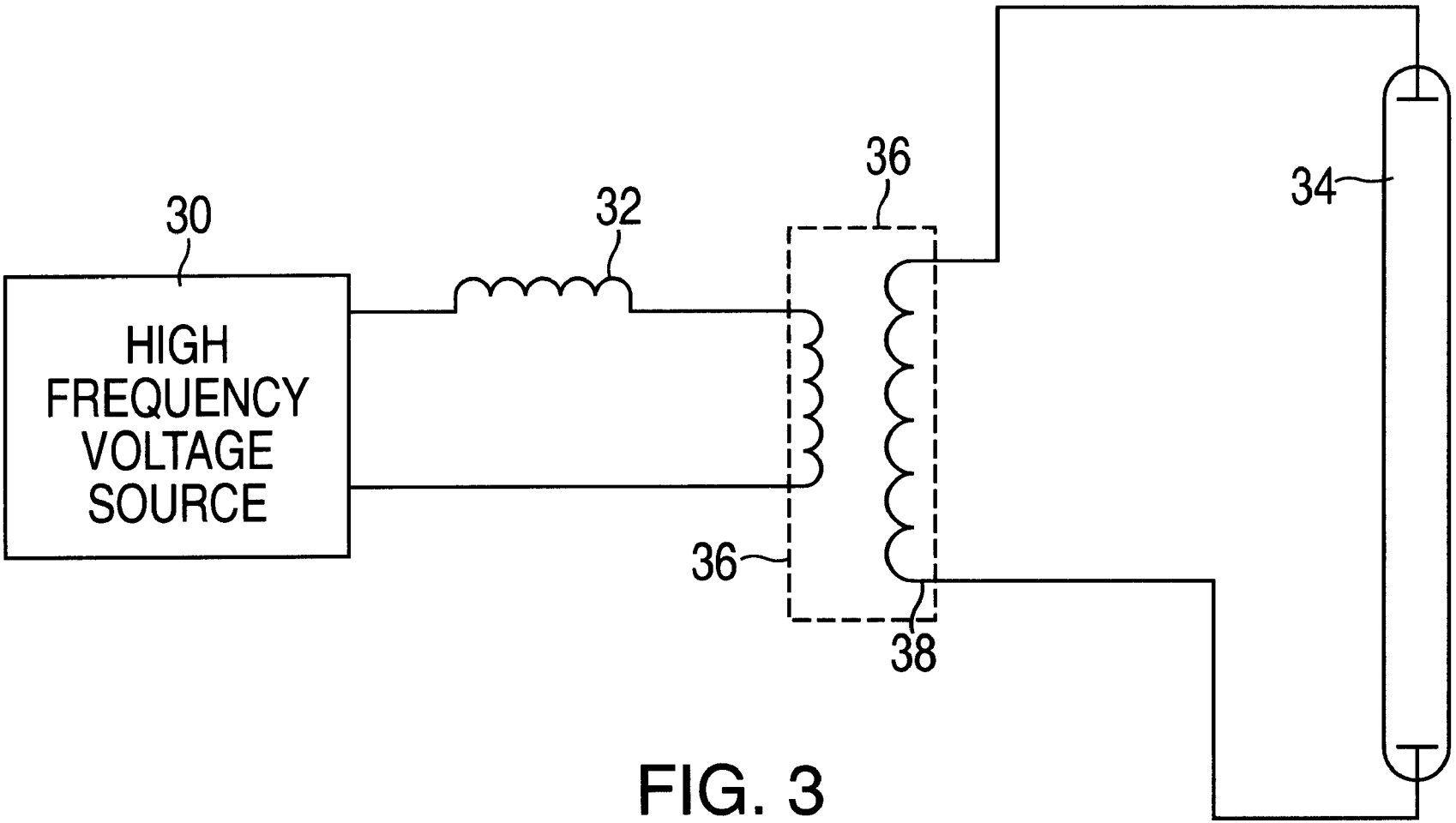
FIG. 3 PRIOR ART
FIG. 3 is a circuit diagram for a conventional neon lamp power supply that includes an asymmetrical voltage source.
Figure 4:
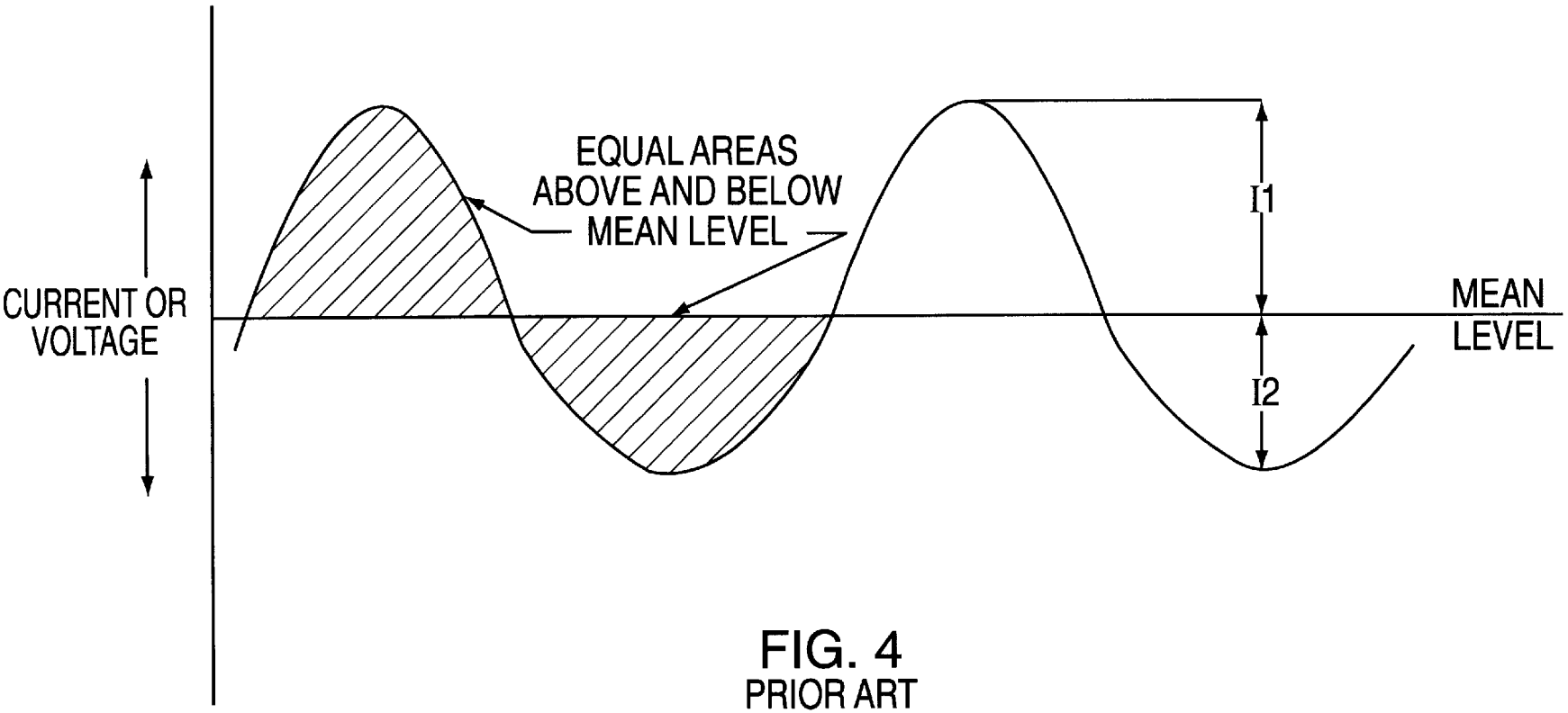
FIG. 4 PRIOR ART
FIG. 4 schematically shows an asymmetrical waveform.

Preferred embodiments of an improved neon lamp power supply according to the present invention are described below with reference to the accompanying drawings, in which like reference numerals represent the same or similar elements.

Figure 5:
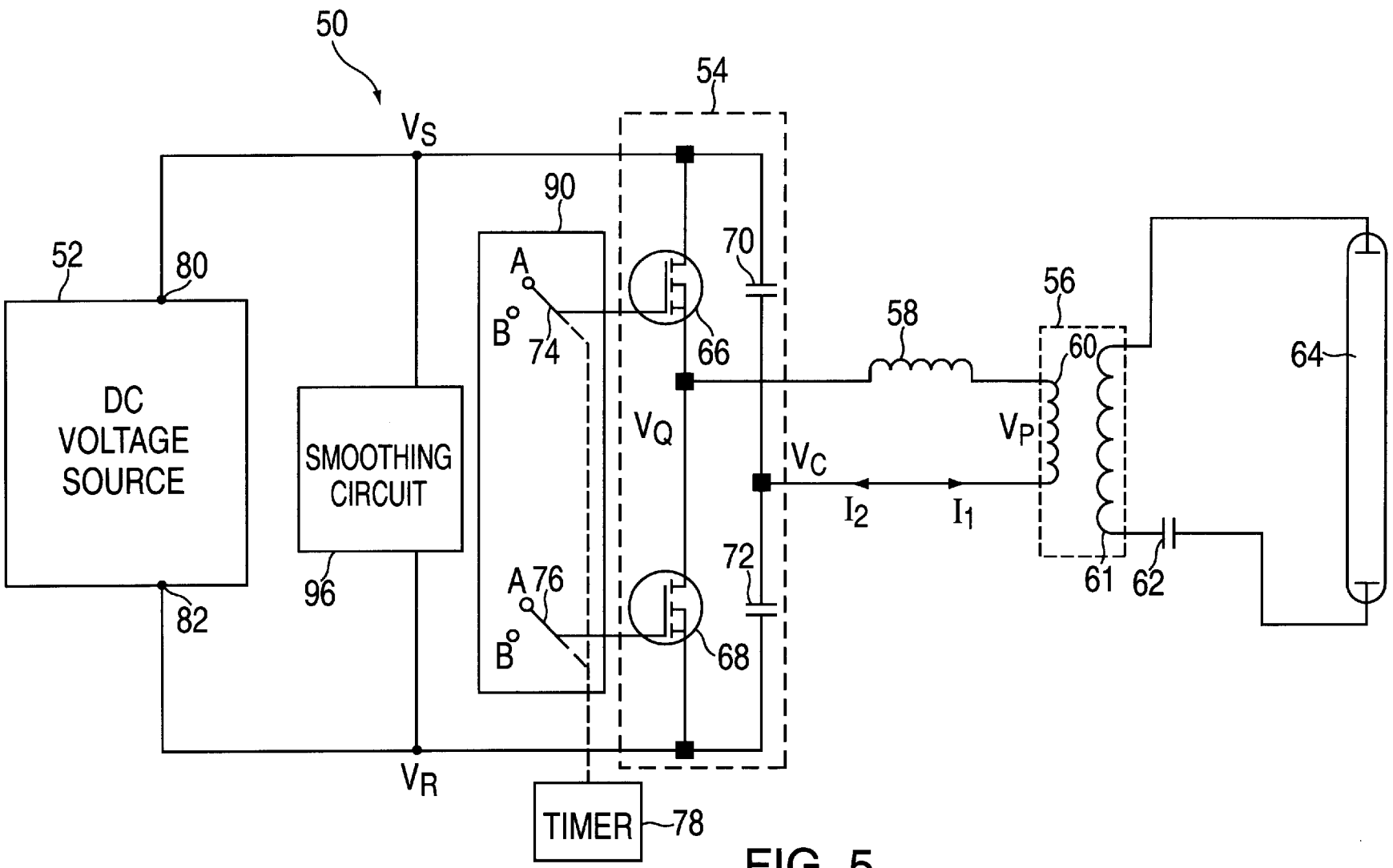
FIG. 5 is a circuit diagram for a neon lamp power supply according to a first embodiment of the present invention.

FIG. 5 is a circuit diagram for a neon lamp power supply 50 according to a first embodiment of the present invention. The power supply 50 is comprised of a DC voltage source 52 connected to a half-bridge inverter 54 which, in turn, is connected with a step-up transformer 56 that steps up the voltage output from the voltage source 52, and an inductor 58 that acts to limit the flow of current to the primary winding 60 of the transformer 56. The transformer 56 is, in turn, connected in series with a blocking capacitor 62 and a neon tube 64. The half-bridge inverter 54 is of a conventional type and is comprised of first and second transistors 66, 68 connected with first and second capacitors 70, 72 in a half-bridge configuration. The first and second transistors 66, 68 are respectively connected to first and second switches 74, 76 of a drive circuit 90. Each of the first and second switches 74, 76 has an "A" state and a "B" state, and both the first and second switches 74, 76 are connected to a timer 78. The first transistor 66 is connected to a supply terminal 80 of the voltage source 52, and the second transistor 68 is connected to a return terminal 82 of the voltage source 52. The blocking capacitor 62 serves to block any DC offset current produced by the power supply 50.

Figure 7A:
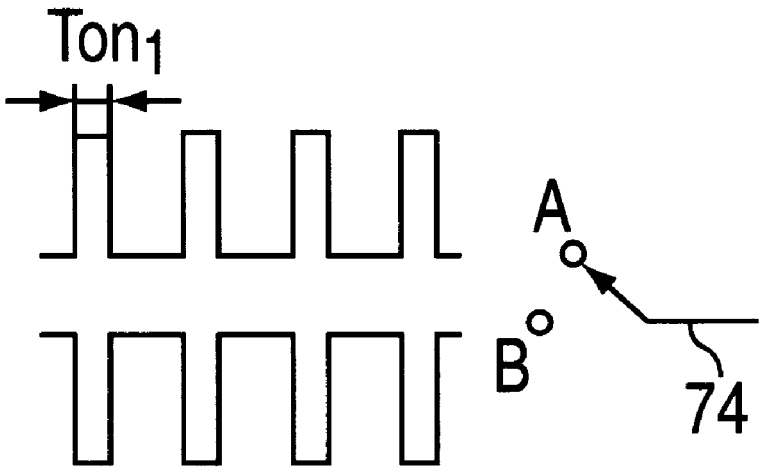
FIGS. 7A and 7B show the drive waveforms for the drive circuit of FIGS. 5 and 6.
Figure 7B:
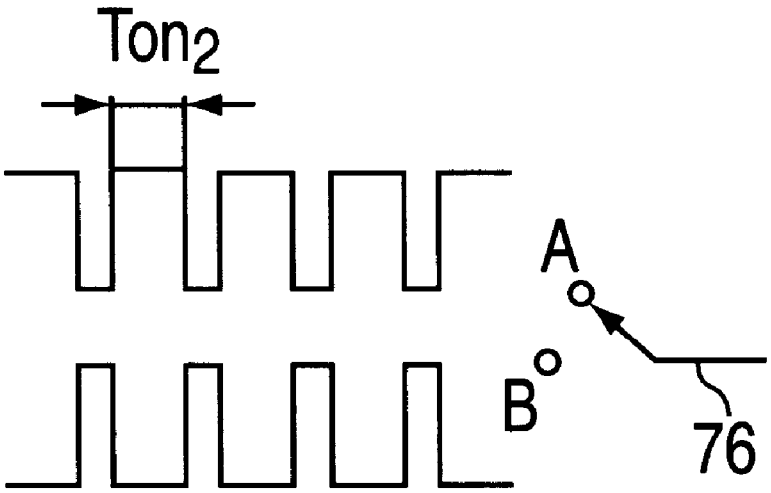

During operation, the first and second transistors 66, 68 are respectively driven by corresponding drive waveforms shown in FIGS. 7A and 7B.

When the drive waveform for the second transistor 68 is in a "high-A" state, indicated by "$T_{on-2}$" in FIG. 7B, and the second transistor 68 is in an "on" state, the corresponding drive waveform for the first transistor 66 is in a "low" state, as shown in FIG. 7A, and the first transistor 66 is in an "off" state. The voltage $V_Q$, which is either the supply voltage $V_S$ or the return voltage $V_R$, takes the value $V_R$. This establishes a current flow from the junction of the first and second capacitors 70, 72 in the direction of $I_2$. An existing current in the inductor 58 remaining from the preceding half-cycle of operation is discharged before the current flow in the direction of $I_2$ is established.

When the drive waveform for the second transistor 68 is in a "low" state, the drive waveform for the first transistor 66 is in a "high-A" state, indicated by "$T_{on-1}$" in FIG. 7A, and the voltage $V_Q$ takes the value of the $V_S$. This establishes a current flow from $V_S$ through the first transistor 66, through the inductor 58, through the primary windings 60 of the transformer 56 to the junction of the first and second capacitors 70, 72 in the direction of $I_1$. An existing current in the inductor 58 remaining from the preceding half-cycle of operation is discharged before the current flow in the direction of current $I_1$ in FIG. 5 is established.

Under equilibrium conditions the net change in charge on the first and second capacitors 70, 72 is zero, and a DC offset voltage $V_C$ adjusts itself until equilibrium is achieved. Since for the "A" waveforms or pulse trains the duty cycle of the first switch 74 is less than the duty cycle of the second switch 76, $V_C$ is less than half of $V_S$. Therefore, the combination of asymmetric duty cycles for the first and second transistors 66, 68 which produces the DC offset voltage $V_C$ prevents the formation of bubbles or beads in the gas discharge of the neon tube 64.

In order to prevent mercury migration in neon lamps containing mercury, the polarity of the DC offset voltage $V_C$ is reversed by periodically interchanging the duty cycles of the first and second transistors 66, 68. Specifically, the first and second switches 74, 76 are periodically and alternately switched between the "A" state and the "B" state by use of the timer 78.

The timer 78 may be comprised of a free-running multivibrator-type circuit or a switch that operates at the frequency of the public utility or a subharmonic thereof. The duty cycle of the "A" state and the "B" state must be 50% for each state in order to prevent mercury migration in mercury-containing neon tubes. According to a preferred embodiment, the timer 78 operates at a frequency that is below the audible range of frequencies in order to avoid generating acoustic noise in the power supply 50. Preferably, the timer 78 has a counting circuit that operates at the public utility frequency or at a related frequency, and the duty cycles are toggled once every several minutes.

Immediately after a change in the duty cycle to reverse the DC polarity, the power supply enters a transient state in which the net charge on the first and second capacitors 70, 72 adjusts to compensate for the new duty cycle. Therefore, it is preferable to minimize this transient by minimizing the capacitance values for the first and second capacitors 70, 72 by using the lowest values that are large enough to sustain normal operation of the half-bridge inverter 54. According to a preferred embodiment, capacitance values of about 2 microfarads are sufficient for power levels of about 200 watts. Optionally, because the first and second capacitors 70, 72 have low capacitance values, as discussed above, they may be replaced with a single capacitor in the position of either the first capacitor 70 or the second capacitor 72 to simplify the construction of the power supply 50.

An optional smoothing circuit 96 may be connected between the DC voltage source 52 and the half-bridge inverter 54 to smooth the voltage supplied to the half-bridge inverter 54.

The inductor 58 may be omitted if the transformer 56 has a leakage inductance that is sufficient to impede the flow of current to the neon tube 64. If the leakage inductance of the transformer 56 is not sufficient for limiting the current flow to the neon tube 64, however, the blocking capacitor 62 may be used to limit the current flow, in which case the transformer 56 must have a sufficiently low bandwidth so that a nearly sinusoidal waveform is produced.

Figure 6:
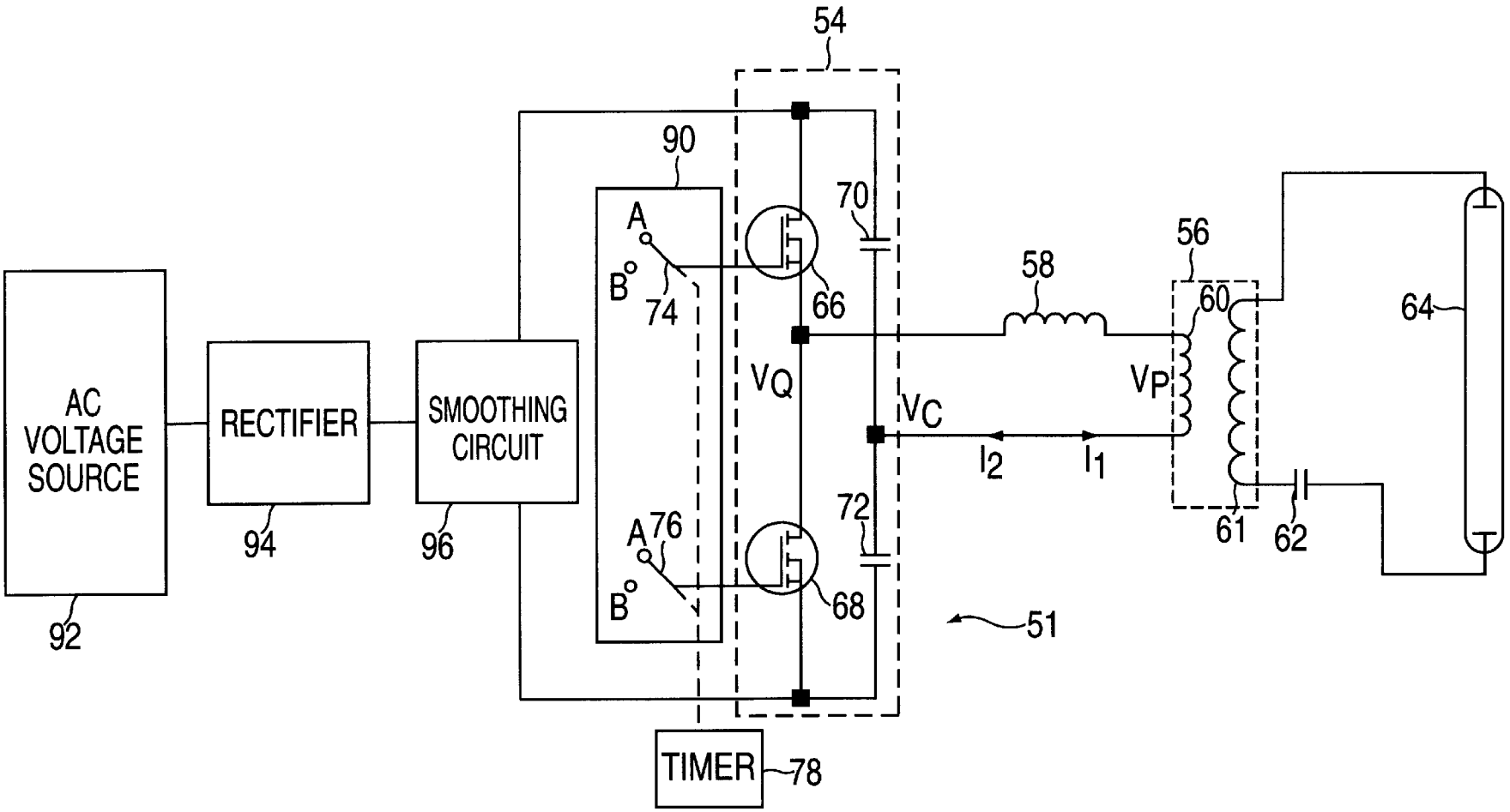
FIG. 6 is a circuit diagram for a neon lamp power supply according to a second embodiment of the present invention.

FIG. 6 is a circuit diagram for a neon lamp power supply 51 according to a second embodiment of the present invention, which is an AC analog of the circuit of FIG. 5. The power supply 51 is comprised of an AC voltage source 92 connected to a rectifier 94 which, in turn, is connected to a half-bridge inverter 54. Other than the AC voltage source 92 and the rectifier 94, the elements of the second embodiment are similar to those of the first embodiment shown in FIG. 5.

The output of the power supply 51 may be controlled to achieve current or voltage regulation by varying the pulse widths while maintaining the desired asymmetry. Conventional pulse-width modulation techniques may be used to vary the pulse widths.

Alternatively, the output of the power supply 51 may be controlled by producing a resonance so that the frequency of the waveform or pulse train may be adjusted toward or away from the resonance in order to adjust the output. The resonance may be produced by adding parallel capacitance to the secondary winding 61 of the transformer 56 or by using existing stray capacitance present in the power supply 51 and combining the stray capacitance with the inductor 58. Preferably, the resonance frequency has a value similar to the operating frequency of the AC voltage source 92.

An optional smoothing circuit 96 may be connected between the AC voltage source 52 and the half-bridge inverter 54 to smooth the voltage supplied to the half-bridge inverter 54.

According to a preferred embodiment, the AC voltage source 52 operates at a higher frequency than the frequency of the public utility.

Figure 8:
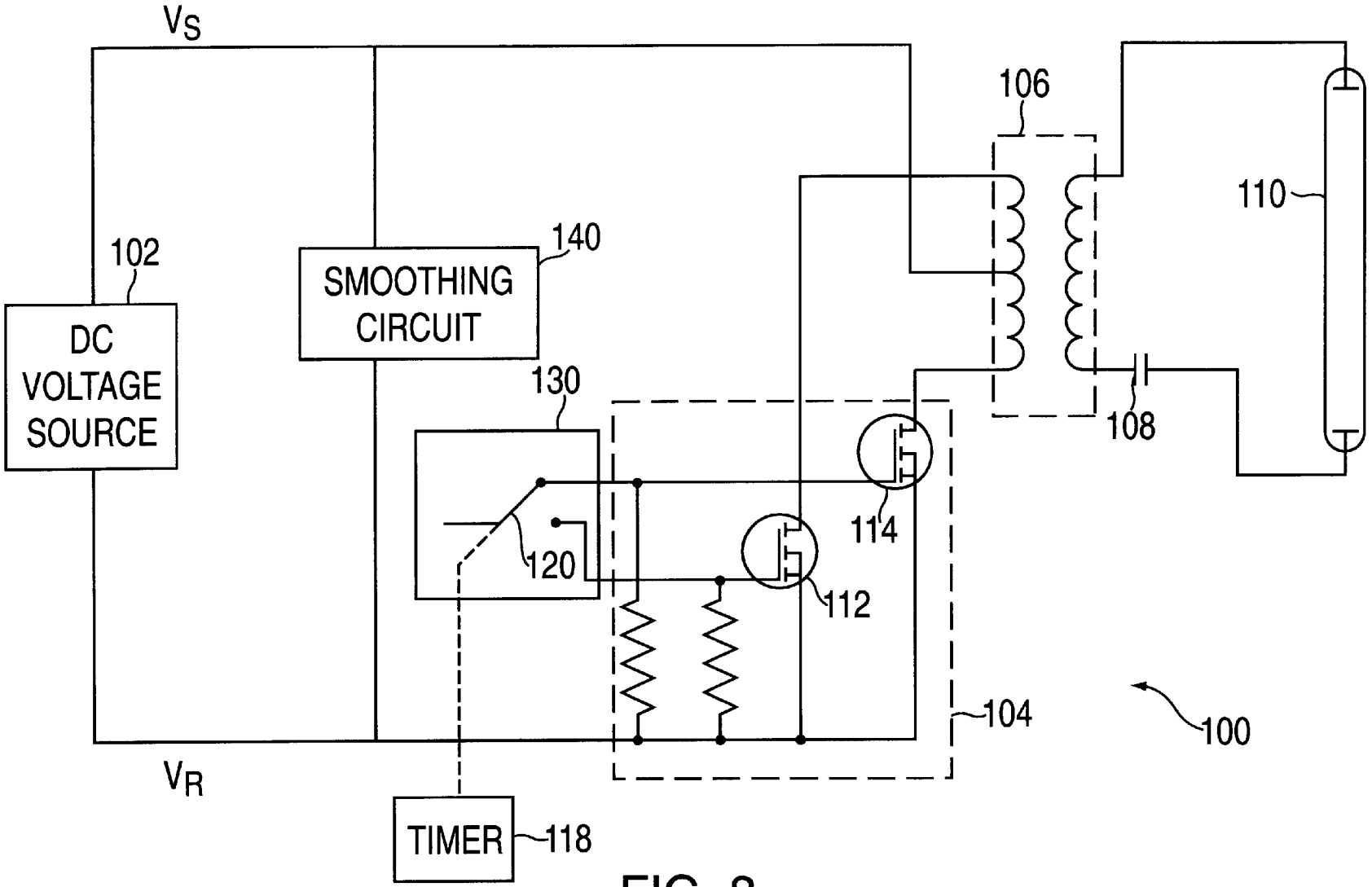
FIG. 8 is a circuit diagram for a neon lamp power supply according to a third embodiment of the present invention.

FIG. 8 is a circuit diagram for a neon lamp power supply 100 according to a third embodiment of the present invention. The power supply 100 is comprised of a DC voltage source 102 connected to an inverter 104 which, in turn, is connected to a step-up transformer 106. The transformer 106 is connected in series with a blocking capacitor 108 and a neon tube 110. A drive circuit 130 connected to a switch 120 and a timer 118 is used to produce an asymmetrical output waveform. The inverter 104 is comprised of first and second MOSFET switches 112, 114 each with a duty cycle that alternates between a finite value and zero. The MOSFET switches 112, 114 alternately behave as a single transistor inverter. An inductor is not used to impede the flow of current to the neon tube 110 because it is assumed that the transformer 106 has a sufficient leakage inductance for that purpose. The transformer 106 must be one that can withstand the DC offset current produced by the inverter 104.

The blocking capacitor 108 serves to prevent the DC offset current from reaching the neon tube 110 so that only the DC offset voltage acts to prevent bubble or bead formation in the gas discharge of the neon tube 110. The blocking capacitor 108 does not affect the flux levels within the transformer 106. If the leakage inductance of the transformer 106 is not sufficient for limiting the flow of current to the neon tube 110, the blocking capacitor 108 may be used to limit the current flow and the transformer 106 must have a sufficiently low bandwidth so that a nearly sinusoidal waveform is produced.

Figure 10:
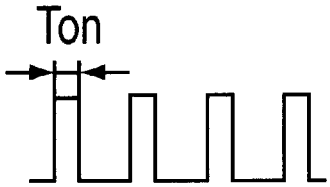
FIG. 10 shows the voltage waveform for the drive circuit of FIGS. 8 and 9.

An example of a drive waveform produced by the drive circuit 130 is shown in FIG. 10.

The timer 118 is used to periodically change the polarity of the DC offset voltage to prevent mercury migration in mercury-containing neon tubes. The timer 118 periodically reverses the asymmetry by reversing the duty cycle of the voltage supplied to the transformer 106. That is, the output waveform from the drive circuit 130 is applied alternately to the first and second MOSFET switches 112, 114 in accordance with the output from the timer 118. The timer 118 may be omitted if the power supply 100 is to be used with tubes containing only neon gas.

An optional smoothing circuit 140 may be connected between the DC voltage source 102 and the half-bridge inverter 104 to smooth the voltage supplied to the half-bridge inverter 104.

Figure 9:
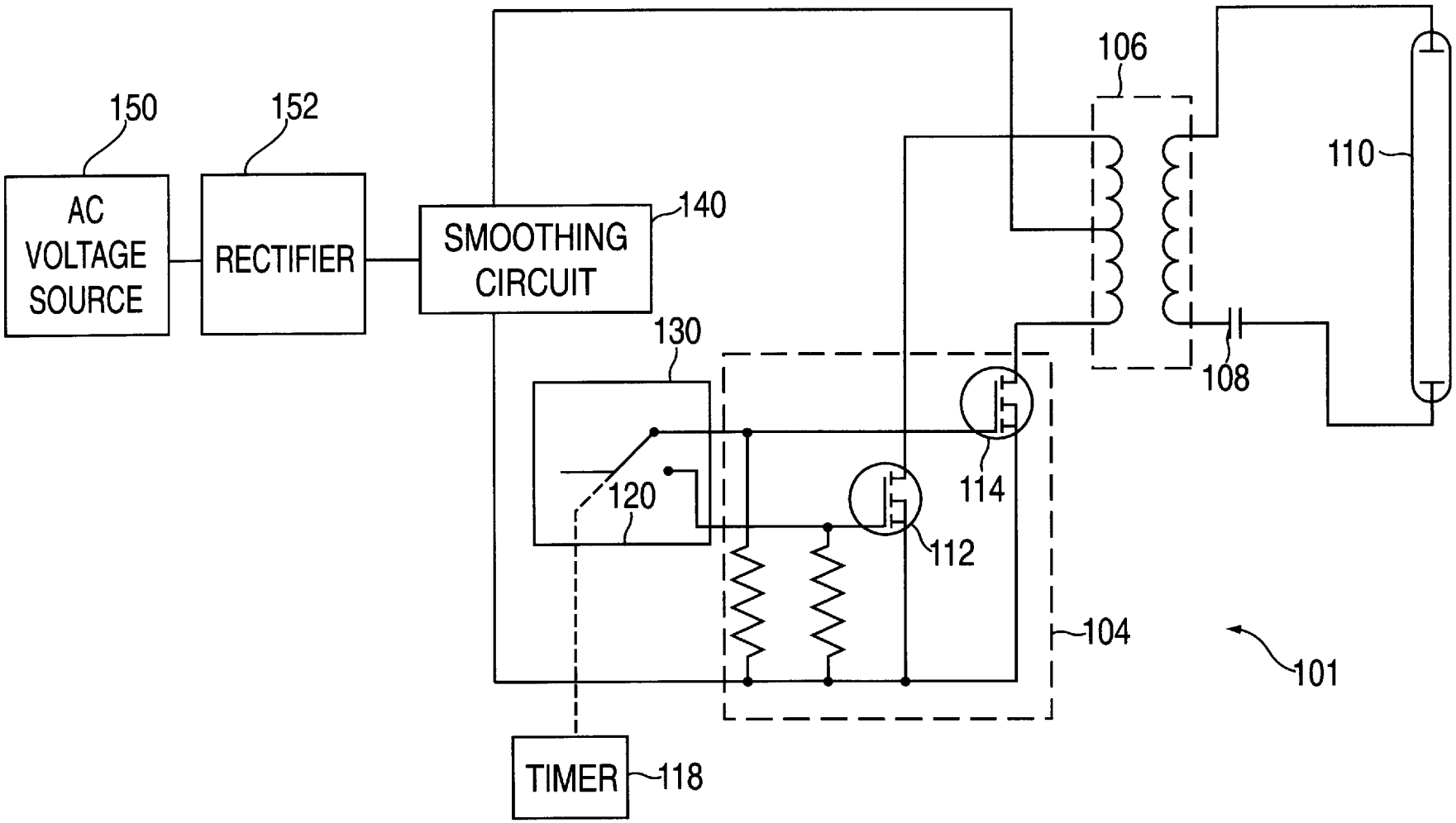
FIG. 9 is a circuit diagram for a neon lamp power supply according to a fourth embodiment of the present invention.

FIG. 9 is a circuit diagram for a neon lamp power supply 101 according to a fourth embodiment of the present invention. The power supply is an AC analog of the circuit of FIG. 8. The power supply 101 is comprised of an AC voltage source 150 connected to a rectifier 152 which, in turn, is connected to an inverter 104. Other than the AC voltage source 150 and the rectifier 152, the elements of the fourth embodiment are similar those of the third embodiment shown in FIG. 8.

An optional smoothing circuit 140 may be connected between the AC voltage source 150 and the half-bridge inverter 104 to smooth the voltage supplied to the half-bridge inverter 104.

According to a preferred embodiment, the AC voltage source 150 operates at a higher frequency than the frequency of the public utility.

The embodiments described above are illustrative examples of the present invention and it should not be construed that the present invention is limited to those particular embodiments. Various changes and modifications may be effected by one skilled in the art without departing from the spirit or scope of the invention as defined in the appended claims. For example, an integrated oscillator/driver circuit may be used instead of the switches 74, 76 in the drive circuit 90 of FIGS. 5 and 6. Also, either mechanical switches or electronic switches, or a combination of both, may be used in the present invention.

What is claimed is:

1. A power supply for a gas-discharge lamp, the power supply comprising:

a voltage apparatus for producing a voltage having an asymmetrical voltage waveform, the voltage apparatus including a voltage source, a half-bridge inverter, and a timer;

a transformer for stepping up the voltage from the voltage apparatus; and a blocking capacitor connected in series with the transformer and the lamp for preventing a DC current from flowing through the transformer and the lamp so that a DC voltage is established across the lamp without a DC current through the lamp, wherein the half-bridge inverter is operatively connected to the voltage source and the transformer and periodically inverts a polarity of an output voltage from the voltage source, and the timer is connected to the inverter and outputs a timing signal to control the inverting performed by the half-bridge inverter, wherein the voltage apparatus includes a drive circuit connected to the timer and the half-bridge inverter for generating the voltage having the asymmetrical voltage waveform fed to the transformer, and the drive circuit includes first and second switches respectively connected to first and second transistors of the half-bridge inverter, each of the first and second switches for switching between respective first and second drive voltages having respective first and second asymmetrical voltages waveforms based on the timing signal output from the timer, wherein the first asymmetrical voltage waveform for each of the first and second switches is inverted in polarity relative to the second asymmetrical voltage waveform for each of the first and second switches.

2. A power supply according to claim 1, further comprising an inductor operatively connected between the transformer and the voltage apparatus for limiting current flow to the lamp.

3. A power supply according to claim 1, wherein the voltage source is a DC voltage source.

4. A power supply according to claim 1, wherein the voltage apparatus includes a smoothing circuit connected between the voltage source and the half-bridge inverter.

5. A power supply according to claim 1, wherein the voltage source is an AC voltage source having a higher operating frequency than a frequency used by a local public utility.

6. A power supply according to claim 5, wherein the voltage apparatus includes a rectifier connected to an output of the voltage source.

7. A power supply according to claim 5, wherein the half-bridge inverter utilizes pulse-width modulation techniques to regulate one of a current having an asymmetrical current waveform and the voltage having the asymmetrical voltage waveform from the voltage apparatus.

8. A power supply according to claim 5, wherein the voltage apparatus includes a resonance circuit with a resonance frequency having a similar value to the operating frequency of the AC voltage source, the resonance circuit allowing the operating frequency to be adjusted without affecting the voltage from the AC voltage source.

9. A power supply according to claim 1, wherein the polarity of the voltage from the voltage apparatus is inverted at a 50% duty cycle by the timer so that an average voltage is zero.

10. A power supply for a gas-discharge lamp, the power supply comprising:

a voltage apparatus for producing a voltage having an asymmetrical waveform, the voltage apparatus including a voltage source, a first single-transistor inverter, a second single-transistor inverter, and a timer for alternately connecting the first single-transistor inverter and the second single-transistor inverter to the voltage source;

a transformer for stepping up the voltage from the voltage apparatus; and a blocking capacitor connected in series with the transformer and the lamp for preventing a DC current from flowing through the transformer and the lamp so that a DC voltage is established across the lamp without a DC current through the lamp, wherein the first single-transistor inverter outputs a voltage waveform having an inverted polarity relative to a voltage waveform output from the second single-transistor inverter.

11. A power supply according to claim 10, wherein the voltage apparatus includes a drive circuit connected to the first and second single-transistor inverters for generating the asymmetrical voltage waveform.

12. A power supply according to claim 10, further comprising an inductor operatively connected between the voltage apparatus and the transformer for limiting current flow to the lamp.

13. A power supply according to claim 10, wherein the voltage source is a DC voltage source.

14. A power supply according to claim 10, wherein the voltage source is an AC voltage source having a higher operating frequency than a frequency use by a local public utility.

15. A power supply according to claim 14, wherein the voltage apparatus includes a resonance circuit with a resonance frequency having a similar value to the operating frequency of the AC voltage source, the resonance circuit allowing the operating frequency to be adjusted without affecting the voltage from the AC voltage source.

16. A power supply according to claim 10, wherein the polarity of the voltage from the voltage apparatus is inverted at a 50% duty cycle by the timer so that an average voltage is zero.

* * * * *